US011175040B2

(12) United States Patent
Tjärnehov et al.

(10) Patent No.: US 11,175,040 B2
(45) Date of Patent: Nov. 16, 2021

(54) OVER FIRING PROTECTION OF COMBUSTION UNIT

(71) Applicant: HALDOR TOPSØE A/S, Kgs. Lyngby (DK)

(72) Inventors: Emil Andreas Tjärnehov, Malmö (SE); Anne Krog Jensen, Allerød (DK); Christian Henrik Speth, Lynge (DK); Peter Bruun Jensen, Bagsværd (DK)

(73) Assignee: HALDOR TOPSØE A/S, Kgs. Lyngby (DK)

( * ) Notice: Subject to any disclaimer, the term of this patent is extended or adjusted under 35 U.S.C. 154(b) by 706 days.

(21) Appl. No.: 16/071,365

(22) PCT Filed: Feb. 20, 2017

(86) PCT No.: PCT/EP2017/053764
§ 371 (c)(1),
(2) Date: Jul. 19, 2018

(87) PCT Pub. No.: WO2017/140906
PCT Pub. Date: Aug. 24, 2017

(65) Prior Publication Data

US 2021/0207804 A1 Jul. 8, 2021

(30) Foreign Application Priority Data

Feb. 19, 2016 (DK) ..... PA 2016 00099

(51) Int. Cl.
*F23N 5/24* (2006.01)
*F23B 40/00* (2006.01)

(52) U.S. Cl.
CPC ..... *F23N 5/242* (2013.01); *F23B 40/00* (2013.01); *F23N 2223/08* (2020.01); *F23N 2225/06* (2020.01); *F23N 2225/08* (2020.01); *F23N 2229/00* (2020.01)

(58) Field of Classification Search
CPC ..... F23N 5/242; F23N 5/24; F23N 2225/06; F23N 2225/08; F23N 2225/10; F23N 2229/00; F23N 2223/08
USPC ..... 431/12
See application file for complete search history.

(56) References Cited

U.S. PATENT DOCUMENTS

| | | | | |
|---|---|---|---|---|
| 3,217,782 | A | 11/1965 | Vosper | |
| 4,915,613 | A | 4/1990 | Landis et al. | |
| 5,984,663 | A | 11/1999 | Joyce | |
| 6,129,284 | A | 10/2000 | Adams et al. | |
| 6,866,202 | B2 * | 3/2005 | Sigafus | F23N 5/203 236/11 |
| 7,293,718 | B2 * | 11/2007 | Sigafus | F23N 1/002 236/11 |
| 2002/0155405 | A1 | 10/2002 | Casey et al. | |
| 2003/0005973 | A1 | 1/2003 | Watanabe et al. | |
| 2003/0059730 | A1 * | 3/2003 | Sigafus | F23N 5/203 431/18 |
| 2005/0048425 | A1 | 3/2005 | Meier | |
| 2005/0159844 | A1 * | 7/2005 | Sigafus | F23N 1/002 700/275 |
| 2008/0233523 | A1 | 9/2008 | Diepenbroek et al. | |
| 2010/0001087 | A1 * | 1/2010 | Gum | F23N 5/025 237/2 A |
| 2013/0133560 | A1 | 5/2013 | Laskowski et al. | |
| 2014/0080075 | A1 | 3/2014 | Young et al. | |
| 2014/0088918 | A1 * | 3/2014 | Miller | G01M 99/00 702/179 |
| 2014/0170570 | A1 * | 6/2014 | Ishii | F23K 5/16 431/2 |
| 2015/0316262 | A1 * | 11/2015 | Immer | F23N 5/00 431/2 |
| 2017/0089266 | A1 * | 3/2017 | Alexander | F23N 5/022 |
| 2017/0167726 | A1 * | 6/2017 | Pancolini | F23N 1/022 |

FOREIGN PATENT DOCUMENTS

| | | | |
|---|---|---|---|
| EP | 0 614 047 | A1 | 9/1994 |
| GB | 1571906 | A | 7/1980 |
| WO | 99/06768 | A1 | 2/1999 |
| WO | 2013/082146 | A1 | 6/2013 |

OTHER PUBLICATIONS

International Search Report (PCT/ISA/210) dated May 24, 2017, by the European Patent Office as the International Searching Authority for International Application No. PCT/EP2017/053764.
Written Opinion (PCT/ISA/237) dated May 24, 2017, by the European Patent Office as the International Searching Authority for International Application No. PCT/EP2017/053764.
Danish Search Report for PA 2016 00099 dated Sep. 30, 2016.
Office Action (Notification of Substantive Examination Report) dated May 19, 2021, by the Saudi Authority for Intellectual Property in corresponding Saudi Arabia Patent Application No. 518392215, (5 pages).

* cited by examiner

*Primary Examiner* — Steven B McAllister
*Assistant Examiner* — Daniel E. Namay
(74) *Attorney, Agent, or Firm* — Buchanan Ingersoll & Rooney P.C.

(57) ABSTRACT

A method and an apparatus for protection of a combustion unit of a chemical process against over firing, the burner(s) of the combustion unit are limited by a fuel and duty limiter which limits the duty based on process feeds, combustion gas and fuel flows.

15 Claims, No Drawings

OVER FIRING PROTECTION OF COMBUSTION UNIT

FIELD OF THE INVENTION

This invention relates to a method and an apparatus to protect a furnace against over firing. The furnace may comprise one or a plurality of burners. More particular, the invention relates to the protection against over firing of a chemical reactor or a fired heater, which otherwise may entail inefficient operation, damage to equipment and production loss.

BACKGROUND OF THE INVENTION

In a number of industrial processes, combustion units are used as a necessary part of a chemical process. Typically, the combustion units have at least one burner and often a plurality of burners, producing a flame from combustion of one or more fuels in a combustion gas.

When operating the one or more burners in the combustion unit, there is a risk of over firing of the combustion unit. The requirement for fuel to the combustion unit is to provide the necessary duty to keep the chemical process running, to heat up the combustion gas and fuel mixture and also during start-up and transient operation to heat up the furnace. If a too small amount of fuel is supplied to the burner(s), the chemical process is not running optimal, but if too much fuel is supplied and if too many or too few burners are in operation, there is a risk of over firing, which may lead to damage to the process equipment and production loss. Burners are commonly controlled by systems comprising temperature measurements, but in general and especially during start-up and transient operation, a change in firing of the burners will be observed with a delay on flue gas and process fluid temperature measurements. Thus, especially during start-up and transient operation of a combustion unit, the time delay is long and the risk of over firing is high.

Therefore a need exists for a method and an apparatus for protecting a combustion unit with one or more burners against over firing, which does not rely only on temperature measurements of the flue gas and process fluids.

In known art, EP0614047 discloses an electronic control device for gas burners of heating installations. To simplify the electronic control device for gas burners of heating installations, the microcomputer of the automatic firing unit is extended to take over tasks from the heating regulator. The microcomputer or the device equipped therewith is provided with a signal generator, a comparator, a controller and a temperature watchdog. The signal generator generates, in particular, pulse-width-modulated control signals, which are used for controlling a D.C. motor, which is used as drive element for an air blower. The comparator compares rotational speed current values of the blower generated by a rotational speed sensor with rotational speed desired values or limiting values stored in the memory and, as a function of the type and/or the magnitude of the difference values, triggers control signals or influences the latter. Furthermore, the microcomputer outputs control signals to the D.C. motor of the blower during the operational time of the burner as a function of parameters controlling the boiler temperature, and takes over temperature watchdog tasks.

U.S. Pat. No. 4,915,613 discloses a method and apparatus to monitor fuel pressure in a heating system where a controller controls actuation of fuel valves. A fuel pressure limit signal is provided to the controller for determining if the fuel pressure crosses predetermined thresholds. In order to avoid nuisance shut-downs, the fuel pressure limit signal is ignored by the controller for a predetermined time interval after the controller has actuated a fuel valve.

In WO9906768 a fault detection apparatus for a boiler system is disclosed which comprises a first pressure sensor in an air supply line, downstream of fan and damper; and a second pressure sensor in the fuel supply line, downstream of the valve. Pressures P1 and P2 sensed respectively by sensors are fed to a microprocessor, together with an indication from sensor of the temperature of the air supply. The microprocessor stores a range of pressure valves across a range of temperatures which are indicative of optimum combustion conditions. Having selected the reference valves appropriate for the temperature sensed, the microprocessor compares them with P1 and P2 and produces a measured response in dependence upon the results of the comparison, and ranging from further monitoring (slight deviation between stored and sensed valves) to emergency shutdown (major deviation between stored and sensed valves).

In US2008233523 a video analytics system for characterization of a flare is disclosed. A video of a flare may be taken for obtaining information so as to appropriately control the flare in an interest of reducing emissions not necessarily favourable to the environment. The system may incorporate a control scenario involving one or more parameters of a flare, which are to be controlled in view of a flare characterization from an algorithmic analysis of the video.

U.S. Pat. No. 3,217,782 describes forced draft air-gas burners utilizing a main gas supply line including a pressure responsive manual reset main gas valve, a primary air source, and a pilot gas supply line including a manual reset pressure response pilot valve, a safety system comprising: means connecting said pressure response pilot valve to be responsive to air pressure of said primary air source to permit said pilot valve to be manually opened and permit gas flow there through into said pilot gas supply line; means connecting said pressure responsive main gas valve to be responsive to pressure in said pilot gas supply line and also responsive to air pressure from said primary air source to permit opening of said main gas valve and establish gas flow in said main gas supply line, a high gas pressure sensing valve, means connecting said high gas pressure sensing valve to be responsive to unsafe high pressure in said main gas supply line to shut-off air pressure from said primary air source to said main gas valve; said main gas valve through its connecting means arranged to be responsive to shut-off of air pressure from said primary air source to close said main gas valve and shut-off supply of gas through said main gas supply line; a low gas pressure sensing valve means operably responsive to unsafe low pressure in said main gas supply line to shut off air pressure from said primary air source to said pilot valve to cause the latter to close and shut off supply of pilot gas line pressures to said main gas valve and thereby cause said latter valve to close and shut off supply of gas to said main gas supply line.

Despite this mentioned prior art, there is still a need for solving the problem of protecting against over firing in a combustion unit in a chemical process, given the challenge of delay of feed-back of flue gas and process fluid temperature measurements especially during changes in firing, especially during start-up and transient operation of the combustion unit.

SUMMARY OF THE INVENTION

To lower the risk of over firing of a combustion unit, the present invention comprises a fuel and duty limiter that limits the duty to the furnace based on process feeds, combustion gas and fuel flows.

The requirement for fuel is to heat up the steam/process gas mixture, combustion air/fuel mixture and also, during start-up and transient operation, to heat up the furnace. A change in firing, especially during start-up, will be observed with a delay on the flue gas and process gas temperature measurement. Thus, at low loads/initial phase of the restart the time-delay is long and the risk for over-firing is high. To lower risk of over-firing it is suggested to have a fuel/duty limiter that limits the duty to the reformer based on the steam, process gas, combustion gas and fuel flows. It is to be understood that there may be a number of feed and fuel flows, and there can also be a plurality of fuel headers. The combustion gas may be air, Oxygen or any range of gases comprising Oxygen.

Apart from fuel/duty limiter it is also possible to utilize existing temperature measurement for feedback to protect against excess firing in top/bottom of furnace or failure of the duty control system. Flue gas and process gas outlet temperature measurements are used (flue gas temperature has fastest response) where the flue gas temperature has a fixed limit based on the capacity of the plant process gas outlet temperature.

To prevent over-firing/flame impingement during a start-up/hot restart, the firing should be increased by igniting more burners and not by increased fuel pressure. Therefore it is suggested to limit the fuel pressure close to minimum heat release for the burners. When sufficient burners have been lit, fuel pressure may be increased accordingly as a function of number of lit burners.

The above does not protect against an un-symmetrical firing pattern. Therefore, the firing pattern should be linked to the process control system with an alarm when an unsymmetrical pattern is used.

In an embodiment of the invention no burners are lit at start up. When a burner is ignited the panel operator will tick the burner on in the process control system after confirmation from a field operator. The process control system will register that the burner is lit and will keep track of how many burners are operating.

The set point for the fuel pressure controller is forced (locked) to a value close to minimum heat release for the burners and the duty controller is forced (locked) to manual with 0% output. When a sufficient number of burners has been ignited the system shall release duty controller, allowing the duty controller to be taken inline. Also the pressure controller may be released allowing the set point of the pressure controller to be changed if required.

In an embodiment of the invention the maximum duty requirement is calculated during the entire operation, used as limitation for firing. The duty limitation shall override the duty control. Thus, the duty cannot be increased above the limiting value without permission by key or similar from the supervisor. The pressure controller shall still overrule and maintain pressure above minimum pressure for the burner via high selector to avoid unstable flames.

In a further embodiment of the invention, the flue gas temperature can be used to limit firing as an extended over firing protection. In an embodiment of the invention, a burner matrix is added where the operator must click ignited burners on. When a burner is ignited the panel operator will tick the burner on in the process control system after confirmation from field operator. The process control system will register that the burner is lit and will keep track of how many burners that are lit. The system can also suggest which burner to ignite next. Further, a function that checks the symmetry of the lit burners can warn the operator if there is non-symmetry.

FEATURES OF THE INVENTION

1. A method for protecting a combustion unit having at least one burner, the method comprising the steps of
a) acquiring a value for the flow of process feeds,
b) acquiring a value for the flow of fuel,
c) acquiring a value for the flow of combustion gas,
d) calculating a value for the provided duty to process, provided by the combustion unit based on inputs comprising the value of step b),
e) calculating a value for the maximum allowable duty to process based on input comprising the value of step a), b) and c),
f) comparing the value of step d) with the value of step e)
g) generating an alarm state output if the value of step d) exceeds the value of step e).

2. A method for protecting a combustion unit according to feature 1, wherein the fuel addition is limited if the value of step d) exceeds the value of step e).

3. A method for protecting a combustion unit according to feature 1 or 2, wherein the combustion unit has a plurality of burners and the method further comprises a step of controlling the pattern of the burners which are ignited, prescribing which burner or burners can be ignited next, and generating an alarm state output if the ignited burners are not in accordance with a range of an acceptable pattern.

4. A method for protecting a combustion unit according to feature 3, wherein the operational state of the burners is detected by means of a flame detection device.

5. A method for protecting a combustion unit according to any of the features 3-4, wherein said flame detection device comprises a human operator.

6. A method for protecting a combustion unit according to any of the features 3-5, wherein said flame detection device comprises at least one camera with a view of the plurality of burners.

7. A method for protecting a combustion unit according to any of the features 3-6, wherein the number of burners which shall be in operation is calculated on the basis of the value of the flow of fuel in step b), the number of burners which are in operation is detected by means of the position of shut-off valves on the fuel lines feeding each of the burners, and the number of burners which shall be in operation is compared to the number of burners which are in operation.

8. A method for protecting a combustion unit according to any of the preceding features, wherein the method further comprises the step of limiting the pressure of the fuel in accordance with the number of burners which are in operation.

9. A method for protecting a combustion unit according to any of the preceding features, wherein the method further comprises the steps of acquiring a value for the flue gas temperature down-stream of the burners, acquiring a value for the temperature of the process gas outlet temperature or outlet gas temperatures and generating an alarm state output if said values are not within a pre-set range.

10. A method for protecting a combustion unit according to feature 9, wherein the pre-set range of the values varies with the capacity of the combustion unit.

11. A method for protecting a combustion unit according to any of the preceding features, wherein the alarm state output comprises visual and/or acoustic alarms.

12. A method for protecting a combustion unit according to any of the preceding features, wherein the alarm state output comprises reducing the fired duty, or shutting down one or more of said burners. 13. A method for protecting a combustion unit according to any of the preceding features, wherein said values are acquired and said calculation are executed at periodic time intervals following the time intervals of the flow measures provided to the process control system.

14. A method for protecting a combustion unit according to feature 13, wherein the length of said periodic time intervals are dependent of whether the combustion unit is in a start-up phase, a steady operation phase or a shut-down phase.

15 Apparatus for protecting a combustion unit having at least one burner, said apparatus comprising a computer operatively coupled with means to receive a) a value for the flow of process feeds, b) a value for the flow of fuel, and adapted to calculate a value for the provided duty to process provided by the combustion unit based on the inputs comprising the values of b), the computer is further adapted to calculate a value for the maximum allowable duty to process based on inputs comprising the value of a) and b), and adapted to comparing the value for the provided duty to process with the value for the maximum allowable duty to process and generating an alarm state output if the value for the provided duty to process exceeds the value of the maximum allowable duty to process.

16. Use of an apparatus according feature 15 for a chemical reactor or a fired heater.

EXAMPLES

Fuel Pressure Limitation

In a case, the limit for number of burners ignited is estimated as 60%, to be verified during commissioning of a system. A check of fuel pressure and duty has been made. The number of burners lit is estimated as:

$$\text{No of burners} = \frac{Q}{HR_B}$$

($Q$ = fired duty, $HR_B$ = heat release per burner)

$$HR_B = \sqrt{\frac{P_{fuel}}{P_{norm}}}$$

($P_{norm}$ = 2.5 kg/cm$^2$ g normal pressure, $P_{fuel}$ = measured fuel pressure)

In the case, already at approximately 15-25% lit burners starts there is an increase in fuel pressure, which is not according to operating manual. The new pressure limitation according to the invention will force up to 60% burners lit before fuel pressure can be increased. In the case it was reported that the burners are unstable at pressure below 1.0 kg/cm$^2$ g which explains the large difference between $P_{actual,\ data}$ and $P_{actual,\ desired}$ at the ignition phase.

Duty/Fuel Limitation

The duty limitation is given by:

$$Q_{Furnace}=Q_{Air}+Q_{Fuel}=(m_{CA}+m_{FG})\times Cp_{FL}\times\Delta T_{FURN}$$
(alternatively $Q_{Furnace}=m_{FL}\times Cp_{FL}\times\Delta T_{FURN}$)

$$Q_{Reformer}=Q_{N2}+Q_{PS}+Q_{PG}+Q_{REAC}=(m_{N2}\times CP_{N2}+m_{PS}\times Cp_{PS}+m_{PG}\times Cp_{PG})\times\Delta T_{REF}+\Delta H_R\times m_{PG}$$

$$Q_{loss}=0.015\times(Q_{Furnace}+Q_{Reformer})$$

$$Q_{max}=Q_{Furnace}+Q_{Reformer}+Q_{loss}+Q_{margin}=1.015\times(Q_{Furnace}+Q_{Reformer})+Q_{margin}$$

No heating term has been included for heating of refractory, tubes and catalyst. For self inspirating burners, flow measurement of combustion air is not possible. Instead a new flue gas measurement must be installed with two independent measurements in the flue gas stack. The limit switch of the false air dampers may be used to confirm closed dampers. Alternatively the oxygen analyzer may be used to estimate the combustion air flow from fuel gas flow and oxygen content.

Parameters are shown in table below

| Variable | Description | Fixed/ Variable | Value | Unit |
|---|---|---|---|---|
| $m_i$ | Massflow, measured or calculated from volume flow and molecular weight | Variable | | |
| $Cp_{FL}$ | Heat capacity flue gas | Fixed | 0.30 | kcal/kg/° C. |
| $Cp_{N2}$ | Heat capacity nitrogen | Fixed | 0.27 | kcal/kg/° C. |
| $Cp_{PS}$ | Heat capacity process steam | Fixed | 0.52 | kcal/kg/° C. |
| $Cp_{PG}$ | Heat capacity process gas | Fixed | 0.95 | kcal/kg/° C. |
| $\Delta T_{FURN}$ | Temperature increase in furnace (air to flue gas) | Fixed | 925 | ° C. |
| $\Delta T_{REF}$ | Temperature increase in reformer ($T_{PG,\ out} - T_{PG,\ in}$) | Fixed | 300 | ° C. |
| $\Delta H_R$ | Average enthalpy of reaction | Fixed | 2500 | kcal/kg |
| $Q_{Margin}$ | Margin on fired duty | Fixed | 0.0 | Gcal/h |

The duty is measured by fuel flow why the range requirement for the measurement is large and therefore a separate fuel valve and fuel flow measurement is required.

The margin for maximum duty ($Q_{margin}$) and the constants above are fixed values but shall be adjustable and checked/adjusted during commissioning of the plant.

Flue Gas Temperature Limitation

As mentioned, the flue gas temperature can be used to limit firing as an extended over firing protection. Maximum flue gas temperature as per calculated in a system for capacity 50-110%:

$$TIC_{FLUE(SP)}=A[°\ C.]+B[°\ C./\%]\times Cap[\%]$$

where A and B are estimated based on 50% and 100% operating case.

This function is extended to lower capacities by:

$$TIC_{FLUE(SP)}=MAX(TD_{TWT},A[°\ C.]+B[°\ C./\%]\times Cap)$$

where $TD_{TWT}$ is design max tube wall temperature.

In a case, at 100% load the flue gas temperature is approximately 1000-1030° C. At 50% load flue gas temperature is 800-850° C. Design tube wall temperature is 916° C. which is used as maximum up to 50% capacity. The function is therefore 0-50% capacity, maximum flue gas temperature 916° C.
100% capacity, maximum flue gas temperature 1050° C.
50-100% capacity, linear function, 916° C. to 1050° C.

To protect the top coil in the waste heat section the temperature indication on the process gas side is used to verify that temperature is below mechanical design temperature. If there is no flow on process gas side flue gas temperature shall be restricted to 500° C. The steam flow+nitrogen flow measurement is used as an indicator that flow is present, i.e. at no steam flow flue gas is restricted to 500° C. (step function at 0% capacity).

The invention claimed is:

1. A method for protecting a combustion unit having at least one burner, the method comprising the steps of a) acquiring a value for the flow of process feeds,
b) acquiring a value for the flow of fuel,
c) acquiring a value for the flow of combustion gas,
d) calculating a value for the provided duty to process, provided by the combustion unit based on inputs comprising the value of step b),
e) calculating a value for the maximum allowable duty to process based on input comprising the value of step a), b) and c),
f) comparing the value of step d) with the value of step e), and
g) generating an alarm state output if the value of step d) exceeds the value of step e);

wherein the combustion unit has a plurality of burners and the method further comprises a step of controlling the pattern of the burners which are ignited, prescribing which burner or burners can be ignited next, and generating an alarm state output if the ignited burners are not in accordance with a range of an acceptable pattern.

2. The method for protecting a combustion unit according to claim 1, wherein fuel addition is limited if the value of step d) exceeds the value of step e).

3. The method for protecting a combustion unit according to claim 1, wherein the operational state of the burners is detected by a flame detection device.

4. The method for protecting a combustion unit according to claim 3, wherein said flame detection device comprises a human operator.

5. The method for protecting a combustion unit according to claim 3, wherein said flame detection device comprises at least one camera with a view of the plurality of burners.

6. The method for protecting a combustion unit according to claim 1, wherein the number of burners which should be in operation is calculated on the basis of the value of the flow of fuel in step b), the number of burners which are in operation is detected by the position of shut-off valves on the fuel lines feeding each of the burners, and the number of burners which should be in operation is compared to the number of burners which are in operation.

7. The method for protecting a combustion unit according to claim 1, wherein the method further comprises the step of limiting the pressure of the fuel in accordance with the number of burners which are in operation.

8. The method for protecting a combustion unit according to claim 1, wherein the method further comprises the steps of acquiring a value for a flue gas temperature down-stream of the burners, acquiring a value for a process gas outlet temperature or outlet gas temperatures and generating an alarm state output if said values are not within a pre-set range.

9. The method for protecting a combustion unit according to claim 8, wherein the pre-set range of the values varies with the capacity of the combustion unit.

10. The method for protecting a combustion unit according to claim 1, wherein the alarm state output comprises visual and/or acoustic alarms.

11. The method for protecting a combustion unit according to claim 1, wherein the alarm state output comprises reducing the fired duty, or shutting down one or more of said burners.

12. The method for protecting a combustion unit according to claim 1, wherein said values are acquired and said calculation are executed at periodic time intervals following the time intervals of the flow measures provided to the process control system.

13. The method for protecting a combustion unit according to claim 12, wherein the length of said periodic time intervals are dependent of whether the combustion unit is in a start-up phase, a steady operation phase or a shut-down phase.

14. An apparatus for protecting a combustion unit having at least one burner, said apparatus comprising a computer configured to receive:

a) a value for the flow of process feeds,
b) a value for the flow of fuel, and adapted to calculate a value for the provided duty to process provided by the combustion unit based on the inputs comprising the values of b), the computer is further adapted to calculate a value for the maximum allowable duty to process based on inputs comprising the value of a) and b), and adapted to comparing the value for the provided duty to process with the value for the maximum allowable duty to process and generating an alarm state output if the value for the provided duty to process exceeds the value of the maximum allowable duty to process;

wherein the combustion unit has a plurality of burners and the method further comprises a step of controlling the pattern of the burners which are ignited, prescribing which burner or burners can be ignited next, and generating an alarm state output if the ignited burners are not in accordance with a range of an acceptable pattern.

15. A method comprising using the apparatus according claim 14 for a chemical reactor or a fired heater.

* * * * *